United States Patent [19]

De Vries

[11] Patent Number: 4,534,658

[45] Date of Patent: Aug. 13, 1985

[54] MIXING APPARATUS, HAVING SEALS WHICH MAY BE SATISFACTORILY CLEANED, PARTICULARLY FOR THE PHARMACEUTICAL INDUSTRY

[75] Inventor: Jan W. De Vries, Zelhem, Netherlands

[73] Assignee: Isem B.V., An Doetinchem, Netherlands

[21] Appl. No.: 615,061

[22] Filed: May 29, 1984

[30] Foreign Application Priority Data

Jun. 6, 1983 [NL] Netherlands ..... 8302015

[51] Int. Cl.[3] ..... B01F 9/22

[52] U.S. Cl. ..... 366/287; 277/103

[58] Field of Search ..... 366/261, 287, 286, 244; 277/73, 103

[56] References Cited

U.S. PATENT DOCUMENTS

| | | | |
|---|---|---|---|
| 3,533,604 | 10/1970 | Sabelis | 366/287 |
| 3,775,863 | 12/1973 | Updegrove | 366/287 |
| 4,145,144 | 3/1979 | Nauta | 366/287 |

FOREIGN PATENT DOCUMENTS

| | | | |
|---|---|---|---|
| 441756 | 8/1964 | Japan | 366/287 |
| 1190314 | 5/1970 | United Kingdom | 366/287 |

*Primary Examiner*—Robert W. Jenkins

*Attorney, Agent, or Firm*—Murray Schaffer

[57] ABSTRACT

A conical container having an upper cover and a vertical axis is provided with a mixing screw supported at the upper end of the container from a central drive shaft to which the inner end of a radial arm is connected, the outer end of which is connected to the upper end of the mixing screw, so as to extend parallel to the conical container wall and to be driven so as to simultaneously rotate around its axis and revolve around the axis of the container.

6 Claims, 4 Drawing Figures

MIXING APPARATUS, HAVING SEALS WHICH MAY BE SATISFACTORILY CLEANED, PARTICULARLY FOR THE PHARMACEUTICAL INDUSTRY

BACKGROUND OF THE INVENTION

The present invention relates to mixing apparatus comprising a conical container having an upper cover and a vertical axis. The mixing screw is supported at the upper end of the container from a central drive shaft to which the inner end of a radial arm is connected, the outer end of which is connected to the upper end of the mixing screw, so as to extend parallel to the conical container wall and to be driven so as to simultaneously rotate around its axis and revolve around the axis of the container.

Mixing apparata are known and may also be used as vacuum drying apparatus. If applied in the pharmaceutical industry, where the mixed material must remain clean and particularly sterile, the mixing apparatus has the disadvantage, that the seals and seams allow material and bacteria to enter and be retained. Furthermore, in the same areas, cleaning liquid, used for cleaning the container, e.g. when shifting to a different material to be mixed, can also be retained. In each instance, the sterility and cleanliness of the apparatus is jeopardized. The invention aims at removing such disadvantages.

SUMMARY OF THE INVENTION

This is achieved according to the invention by forming the radial arm as a closed tubular section which at its inner end terminates in a vertical part extending to a position adjacent the container cover. The vertical part is connected with a central drive shaft by which the arm is rotated about the vertical axis at its inner end and causing its outer end to revolve circumferentially about the axis. A seal is removably provided between the vertical part and the cover at the position of the passage of the vertical part through the cover. The outer end of the closed tubular arm has an opening in which a bearing for the upper end of the mixing screw is provided. The bearing includes a seal removably provided between an outer bearing sleeve fixed in the opening of the tubular section and an inner bearing sleeve fixed on the screw end.

Consequently only two seal assemblies are provided which communicate with the mixing container contents. These assemblies are such that the seals may be removed and cleaned remote from the apparatus without the necessity of taking apart the complete driving assembly.

Preferably the seal between the tubular section forming the radial arm and the cover comprises an elastic sealing element which is arranged between a ring which is removably provided in an opening in the upper cover of the container, around the central drive shaft, and a wall of the vertical part.

For ease in cleaning, the simplest construction may be obtained if the sealing element is secured to the ring and the ring is adapted to be lifted above the container cover by means of a piston cylinder assembly.

Preferably, the seal between the tubular section forming the radial arm and the mixing screw comprises an elastic sealing element which is arranged between a ring which is removably provided in the upper arm wall and a bearing sleeve in the tubular section. Thus, through a manhole provided in the container cover, the seal may easily be removed.

With the known mixing apparatus an intermediate shaft is provided in the radial arm which is coupled through bevel gears to the drive shaft for the rotation of the mixing screw around its own axis, and to the mixing screw per se. Oil or grease for lubricating said gears then possibly could lead to contamination of the container contents.

Therefore, it is advantageous if, according to a further feature of the invention a drive shaft for rotating the mixing screw around its axis, is coupled, within the tubular section forming the radial arm through a universal joint, to the shaft of a first belt pulley, which pulley is coupled through a belt with a second belt pulley which is secured to the mixing screw. The belt and the pulleys for the transmission need not to be lubricated at all.

A favorable structure is obtained if a second belt pulley is secured to the mixing screw and journalled on the exterior side of the bearing sleeve, whereas the mixing screw shaft or a connection piece respectively between said shaft and the ring extends within said sleeve. The opening in the upper wall of the radial arm, in which the ring is provided, may additionally be closed by a separate cover.

The invention will be further explained with reference to the drawing, showing an illustrative embodiment of the mixing apparatus according to the invention.

DESCRIPTION OF THE INVENTION

Figure 1:
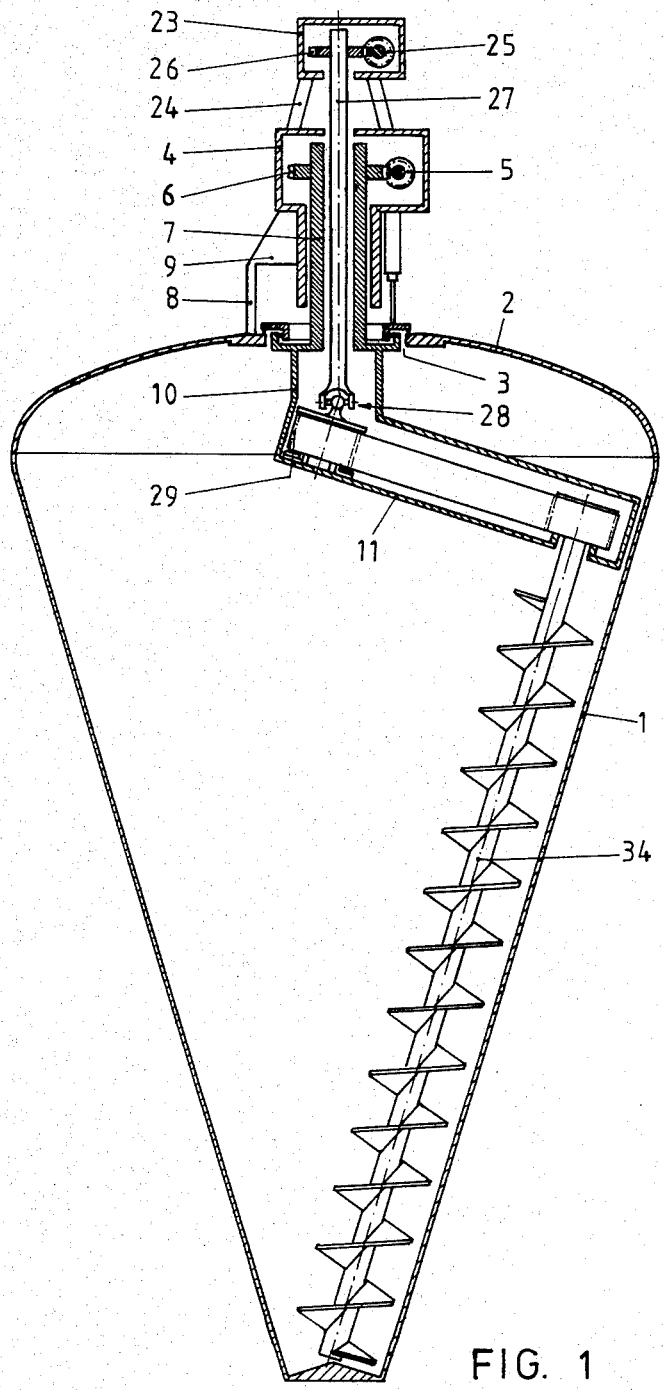
FIG. 1 is vertical section of the upper part of a mixing apparatus and of the driving assembly for the mixing screw according to the present invention.

The mixing apparatus shown in FIG. 1 comprises a conical container 1, having a spherically shaped upper cover 2. Mounted in housing 4 above the cover 2 and extending in part through a central aperture 3 in the upper cover is a driving assembly for revolving the screw. The driving assembly, is an electromotor having the output shaft (both of which are not shown) which drives a worm 5, which is in engagement with a wormwheel 6, which is keyed to a hollow shaft 7 extending downwardly into the aperture 3 in the upper cover. The housing 4 has at its lower end an extension 8 which is secured through three feet 9, one of which is shown, by screw bolts to the surface of the cover 2 around the aperture 3.

Secured by screw bolts to the lower end of the hollow shaft 7 is an upwardly extending vertical tubular section 10 which is integrally formed with a hollow tubular radial arm 11, which will be further explained below.

Figure 2:
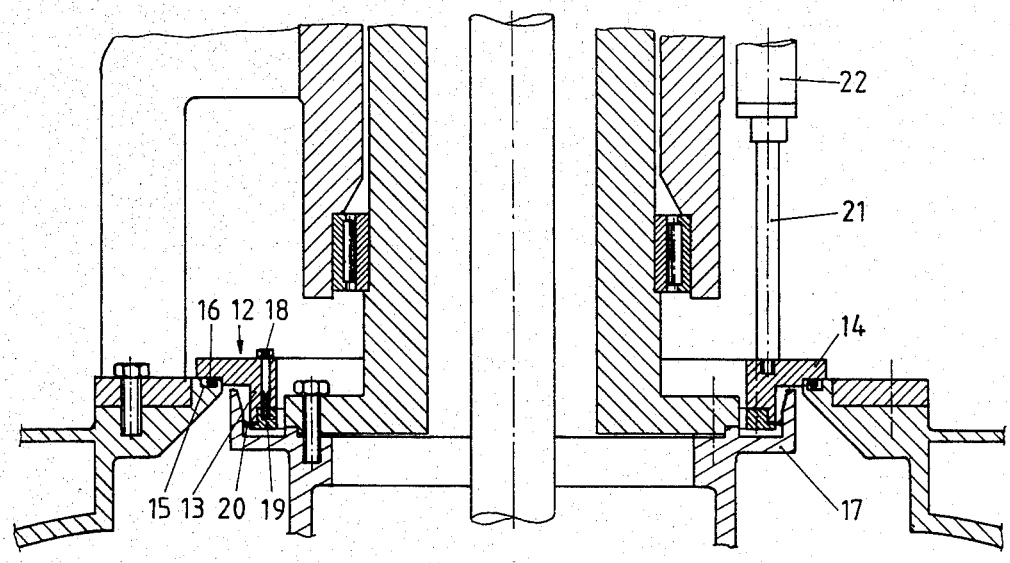
FIG. 2 is a partial vertical section showing in enlarged detail the sealing structure at the position of the container cover.

The seal structure between the central drive shaft 7 and the aperture 3 in the cover of the container 1 is seen in FIG. 2 and comprises a ring 12 having a vertical tube shaped portion 13 and a horizontal flange 14. The flange 14 is supported on the edge of the cover 2 adjacent the aperture 3. An O-ring 16 is received in a chamber 15 in the upper surface of the cover 2. The vertical upper part 10 of the radial arm has at its upper end a tubular extension 17, which freely engages with clearance around the tubular portion 13 of the ring 12. An elastic sealing element, in this case a so-called lip-seal 20, is clamped to the ring 12 through a clamping ring 19, which is secured through screws 18. The lip seal 20 slidably engages the inner side of the tubular extension 17. The ring 12 may be secured through screws to the cover 2 about the aperture edge, but in the preferred embodiment shown, the ring is connected to a piston rod 21 extending from a piston cylinder device 22, the upper end of which is secured to the housing 4. The piston cylinder device may be actuated hydraulically or pneumatically and is adapted to rigidly clamp the ring 12, into position against seal 16 and to seat seal 20 against the tubular extension 17, in one position and to lift the ring and lip seal above the cover, in another position so that it may be subject to cleansing.

Although the seal 20 is already greatly protected through the tubular extension 17 of the vertical part 10 against contact with material in the mixing container (as seen in the drawing the extension 17 extends so as to be close to the lower edge of the flange 14) it remains possible that material, in particular cleaning liquid, may reach the sealing element 20. Material remaining at the sealing element 20 may cause the growth of bacteria and might lead to contamination of the mixing container contents. Therefore, at intervals, it is necessary to remove the sealing element, to clean it and if necessary, replace it. This is accomplished very simply by lifting the ring 12 by operation of the piston cylinder device 22, whereafter through removing the screws 18, the clamping ring 19 may be taken out, and the gaps between the ring and the sealing element may be cleaned. Material abraded from the seal 20 collecting in the chamber formed within the extension 17 does not enter the product in the container, but may be easily removed.

Figure 3:
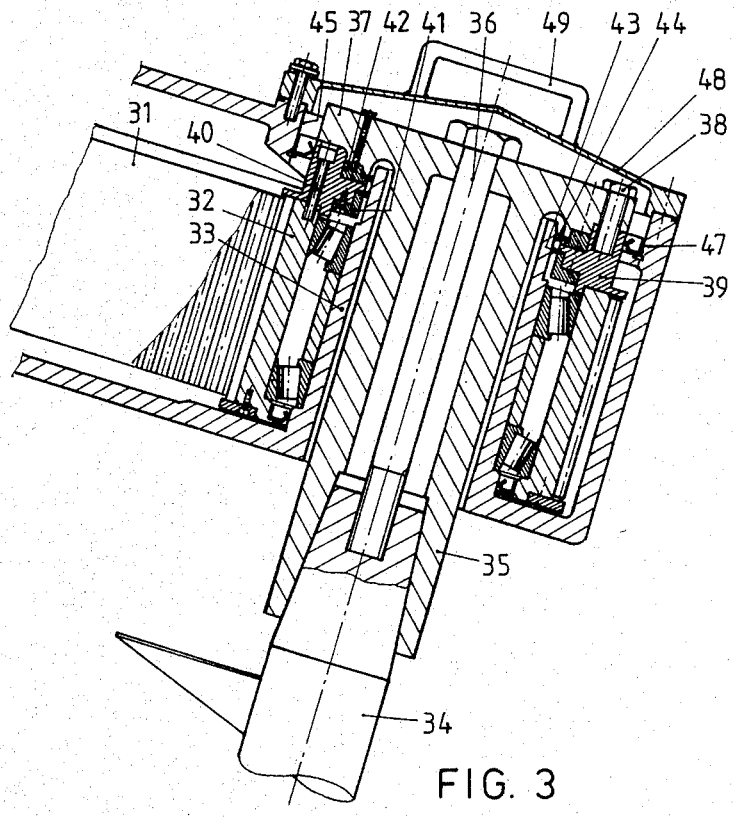
FIG. 3 is a section through the sealing structure at the outer end of the radial arm.
Figure 4:
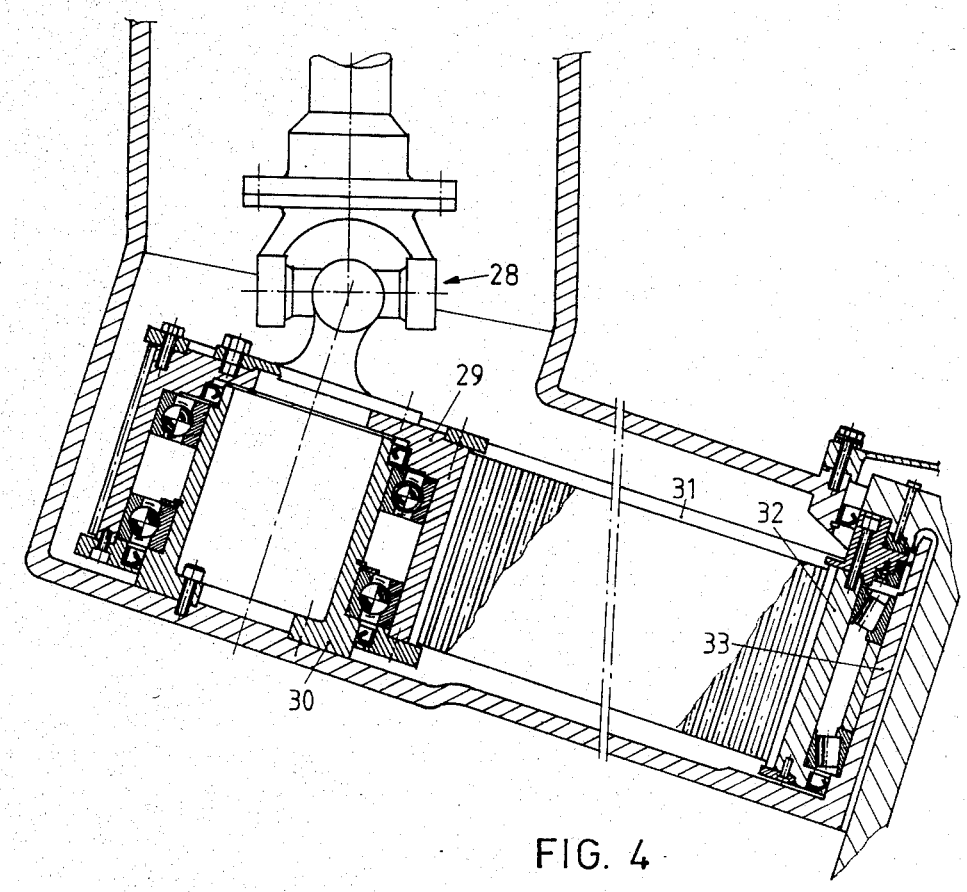
FIG. 4 is a section through the inner end of the radial arm, showing the timing belt transmission.

A second drive assembly for operating the screw comprises a housing 23 mounted on feet 24 on the housing 4. An electromotor (not shown) is housed in the housing 23, the output shaft of which drives a worm 25, which is in engagement with a wormwheel 26, which is secured to a solid shaft 27 extending downwardly through the hollow drive shaft 7 and through the vertical upper part 10 of the radial arm 11. Secured at the lower end of the shaft 27 is one half of a universal joint 28, the other half of which is secured to a pulley 29, which is journalled on a sleeve 30 through ball bearings. The sleeve 36 is secured in the radial arm 11 (see FIG. 4). A belt 31 entrained over the pulley 30 extends over a second pulley 32, which is journalled on a sleeve 33 through conical roller bearings (see FIG. 3). The sleeve 33 is secured to the outer end of the radial arm 11. A mixing screw 34 is secured to the second pulley 32 through structure which will be described below. The belt 31 is prefereably a timing belt issuing a consistent steady movement of the screw under load conditions. The belt may be provided with transverse flutes, cogs, or the like and the pulley similarly formed. The belt is relatively wide, so as to insure against skewing and slippage. Through the last mentioned drive, the mixing screw may be driven around its axis.

A sleeve 35 is secured to the upper end of the mixing screw shaft 34 through a central screw 36. The sleeve 35 extends with clearance through the bearing sleeve 33 and at its upper end is provided with a flange 37, which is secured through screws 38 to an intermediate ring 39, which in turn is secured through screws 40 to the upper end of the second pulley 32.

Clamping rings 41 and 42, are secured by bolts to the intermediate ring 39 and to the flange 37 respectively and elastic sealing elements such as lip seals 43 and 44 respectively, are connected to the sleeve 35 and engage the outer side of the upper end of the bearing sleeve 33.

By removing the screw 36, the sleeve 35 together with the sealing elements may be removed through an opening 45 in the upper side of the tubular radial arm 11 and may be cleaned. Simultaneously the spaces outside and inside the sleeve 33 may also be cleaned. The space between the flange 37 and the inner edge of the opening 45 is sealed by an elastic cup ring 47, and the opening 45 in the tubular arm is closed by a cover 48 which may be secured by screws. The cover is provided with a handle 49, permitting the cover to be easily taken from the container after removing the screws securing it, through a manhole (not shown) in the upper cover 2 of the container or through the top of the container with the cover removed.

The radial arm 11 and its vertical upper part 10 constitute an integral closed tubular section. The open upper end of the vertical part 10, which is secured to the central drive shaft 7 is situated beyond the sealing element 20, with reference to the container contents, whereas the sealing structure between the mixing screw shaft and the tubular arm is constituted by the sealing elements 43 and 44. Both elements may easily be removed and cleaned and the arm is maintained while completely closed. The transmission between the drive shaft 27 and the mixing screw comprises a universal joint as shown and the belt transmission which need not to be lubricated by oil or grease. Therefore, no oil will reach the sealing elements. Due to the structure comprising the sleeve 35 and the flange 37, the sealing assembly between the mixing screw and the radial arm has been positioned at the upper side of the arm, so that the associated sealing elements are easily demountable. The belt may be inserted in folded condition through the aperture at the upper side of the vertical part 10 of the arm, around the first timing belt pulley 29, and may be extended by means of an auxiliary tool towards the outer end of the arm and may be placed around the second pulley 32, whereafter the second pulley is mounted around its bearing sleeve 33.

It is to be noted that the sealing elements will form effective seals with over-pressure or with vacuum within the container. The lip seals are manufactured of teflon or similar material which are resistant against chemicals, e.g. the cleaning liquids.

I claim:

1. In mixing apparatus comprising a conical container closed at its upper end by a cover and a mixing screw located in said container, said screw extending parallel to the conical wall of said end and having drive means for simultaneously rotating said screw about its axis and around the central axis of the container, comprising a central drive shaft extending through said cover, a radial arm connected at its inner end to said central drive shaft, said supporting the mixing screw at its outer end, the improvement wherein said radial arm comprises a closed tubular section terminating at its inner end in a vertical part extending into proximity with the cover and being connected to the central drive shaft, a sealing element removably arranged between said vertical part and the cover at the position of the passage of said vertical part through the cover, the outer end of the tubular section having an opening, and a bearing structure located in said opening for rotatably supporting the upper end of the screw comprising a first bearing sleeve secured in the opening and a second bearing sleeve secured to the end of said screw, including a sealing structure removably arranged between the first bearing sleeve and the second bearing sleeve at the end of the screw.

2. The mixing apparatus according to claim 1, wherein the sealing element between the arm and the cover includes an elastic annular seal arranged between a ring which is removably mounted in the aperture in the upper cover and a radially surrounding wall at the end of the vertical part.

3. The mixing apparatus according to claim 2, wherein the sealing element is secured to the ring and said ring is connected to a piston cylinder device operable to lift said ring from said aperture to a position above the container cover.

4. The mixing apparatus according to claim 1, wherein the sealing assembly between the arm and the mixing screw comprises an annular elastic seal arranged between a ring which is removably secured in the upper wall of the arm, and a bearing sleeve secured in the tubular section.

5. The mixing apparatus according to claim 4, wherein said drive means includes a second drive shaft extending through said central drive shaft and having a universal joint at its lower end within said radial arm, a first pulley connected to said universal joint and coupled through a belt to a second pulley secured to the mixing screw.

6. The mixing apparatus according to claim 5, wherein the second belt pulley is secured to the mixing screw and is journalled on the exterior side of the bearing sleeve, and the mixing screw has a shaft member extending axially through said sleeve.

* * * * *